United States Patent [19]

Pelavin

[11] 4,189,036

[45] Feb. 19, 1980

[54] GARMENT BAG WITH CONSTRAINED HANGERS

[75] Inventor: Joseph Y. Pelavin, North Bergen, N.J.

[73] Assignee: Lark Luggage Corporation, New York, N.Y.

[21] Appl. No.: 951,093

[22] Filed: Oct. 13, 1978

[51] Int. Cl.[2] ..... A45C 3/00

[52] U.S. Cl. ..... 190/43; 206/287

[58] Field of Search ..... 190/43, 41 B; 206/279, 206/284, 285, 286, 287

[56] References Cited

U.S. PATENT DOCUMENTS

| | | | |
|---|---|---|---|
| 2,568,158 | 9/1951 | McWhorter | 206/287 |
| 3,115,959 | 12/1963 | Jaffe | 190/43 |
| 3,139,165 | 6/1964 | Taussig | 190/43 |
| 3,244,261 | 4/1966 | Herz | 190/43 |
| 3,612,260 | 10/1971 | Brilhart | 190/43 UX |
| 3,737,013 | 6/1973 | Powell | 190/43 |
| 3,809,194 | 5/1974 | Chappelle | 190/43 X |
| 3,958,675 | 5/1976 | Rosenblum | 190/43 |

*Primary Examiner*—Donald F. Norton

*Attorney, Agent, or Firm*—Blum, Kaplan, Friedman, Silberman & Beran

[57] ABSTRACT

A foldable garment bag has hooks of separable hangers extended externally from the upper end, and includes a double strap and tabs attached to the bag. One strap member passes beneath the hanger hooks and holds the folded-up portion of the bag; the other strap member loops over a horizontal, linear portion of each hanger hook and constrains the hangers to the bag. The lateral tabs cooperate with the double strap to maintain the folded condition of the bag.

16 Claims, 5 Drawing Figures

68
72
70
16
44
30
62
18
63
48
60
62
10
64
66
64
24
42
20
12
43
40
40

68
3
16
70
72
50
5
18
30
53
34
44
34
46
3
38
38
5
49
39
60
26
24
20
14
28
22

72
68
70
70
50
26
53
52
54
48
46
39
45
60
42
14
12

FIG. 4
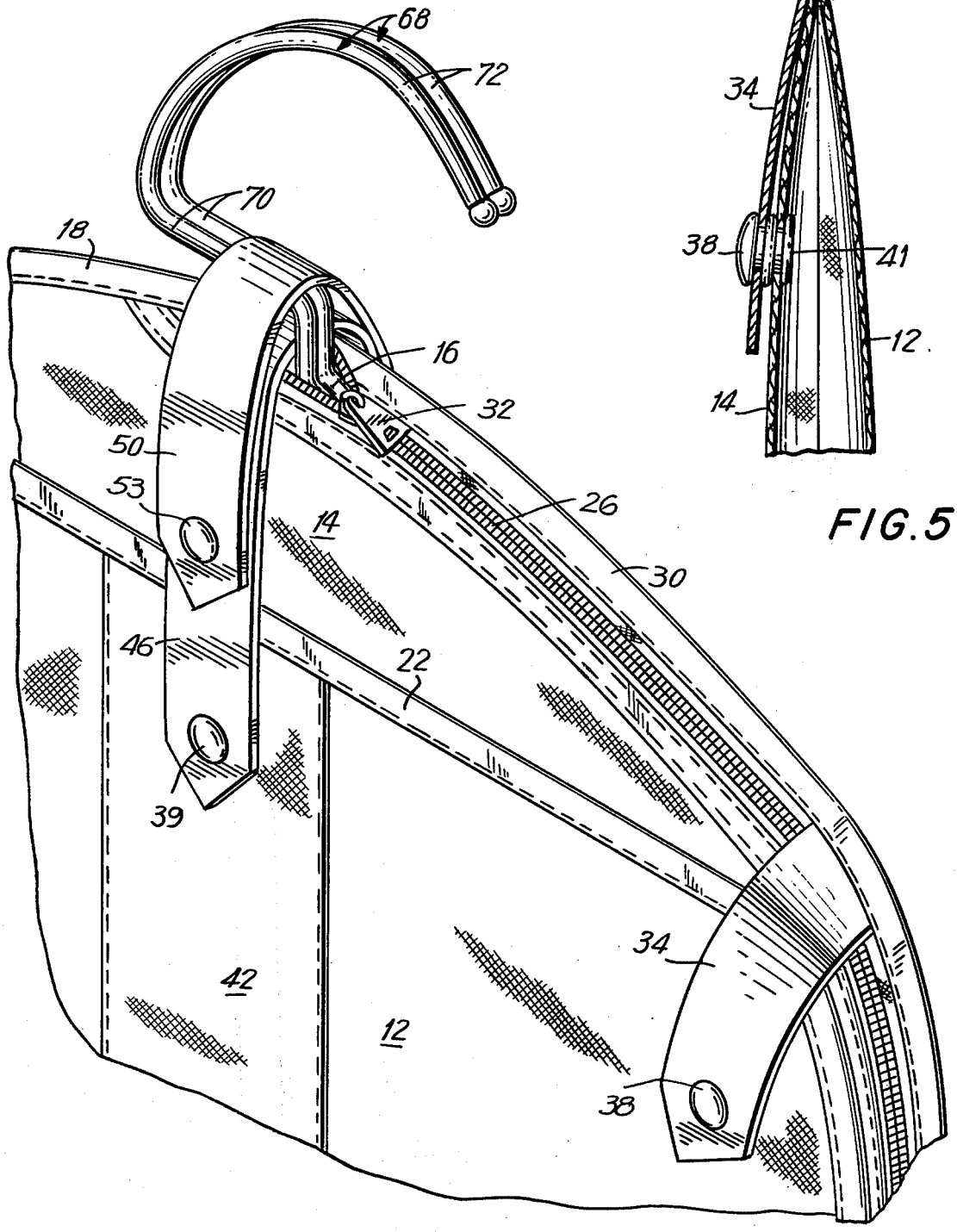
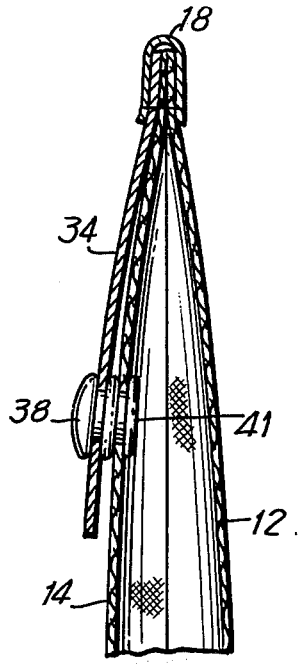
FIG. 5

GARMENT BAG WITH CONSTRAINED HANGERS

BACKGROUND OF THE INVENTION

This invention relates generally to a garment bag of the type used to transport garments stored on separate hangers and more particularly to a garment bag where the hooks of the garment-bearing hangers extend through the upper end of the bag to provide a hand-grip when the bag is being transported, and to provide the point of suspension when the bag is stored, for example, on a closet rack. In the art, a small opening is generally provided centrally at the upper end of the bag for passage therethrough of the hanger hooks. Ideally the hooks are readily available to the person who wishes to transport the loaded bag. Unfortunately when the loaded bag has been lying flat, for example, on the rear seat of an automobile, or when a hanging loaded bag is lifted from the rack for purposes of hand-carriage, the hanger hooks, all or some, may slide through the top opening and become inaccessable to the user until the bag is opened.

Additionally when the bag is lifted by the hanger hooks, and, as described above, one or more hangers have slipped through the top opening, the unhooked garments and their hangers fall to the bottom of the bag. Aside from the inconvenience of retrieving the fallen garments, the garment bag, designed primarily as a covering for clothing, now bears the unintended weight load of the garments. This stresses the bag walls and top and can cause tearing which most frequently occurs proximate the central top opening.

What is needed is a garment bag which secures the separate and independent hangers and prevents the unintended slippage of the hanger hooks through the top opening.

SUMMARY OF THE INVENTION

Generally speaking, in accordance with the invention, a foldable garment bag especially suitable for transporting garments is provided. A double strap is attached to the front wall of the bag adjacent to the top central opening. The first strap member, in surface contact with the front wall, loops over the bag top and is releasably attached to the back wall. C-shaped hanger hooks protrude from the bag compartment and each hook has a substantially horizontal segment extending over the first strap member. The second strap member, overlaying and attached at the front to the first strap member, loops over the horizontal segments of the hanger hooks and is releasably secured to the first strap member. Accordingly while the strap members are secured, the hanger hooks are restrained between the strap members and are prevented from slipping into the bag compartment or from moving substantially away from the top center of the bag. When the strap members are released the hangers are individually detachable from the garment bag in the conventional manner.

When the garment bag is folded, the first strap member is releasably attached near the bottom center of the folded bag, and in cooperation with lateral tabs maintains the folded condition of the bag while simultaneously restraining the hanger hook.

Accordingly, it is an object of this invention to provide an improved foldable garment bag having straps capable of preventing the hanger hooks from being laterally displaced or sliding into the bag interior.

Another object of this invention is to provide an improved foldable garment bag which is easily removed from a storage rack.

A further object of this invention is to provide an improved foldable garment bag which supports the folded bag centrally and laterally.

Still another object of this invention is to provide separable hangers with horizontal elements for cooperation with bag straps which secure the hanger to the garment bag.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 4 is a partial perspective view of the garment bag of FIG. 1 in the folded condition; and FIG. 5 is a view taken along the line 5—5 of FIG. 2.

DESCRIPTION OF THE PREFERRED EMBODIMENTS

Figure 1:
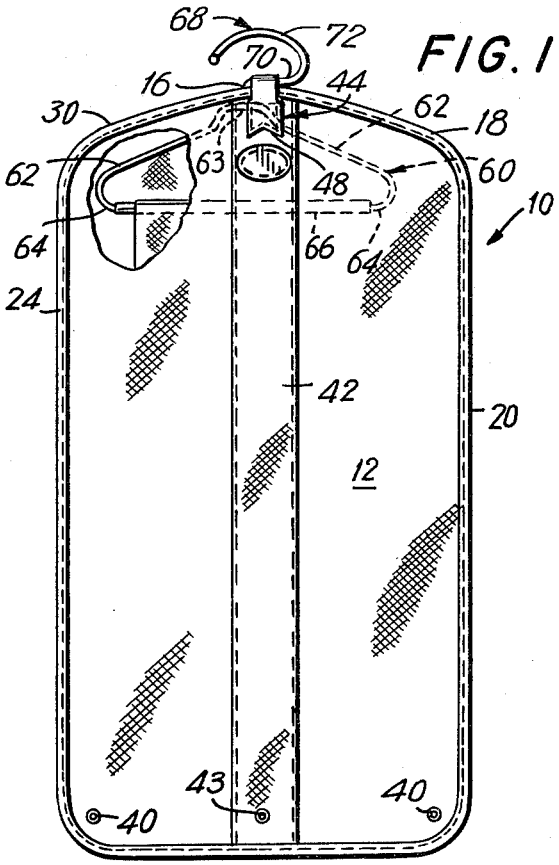
FIG. 1 is a front view of the garment bag with hangers of this invention.

With reference to the Figures, the garment bag 10 of this invention includes a front wall 12, joined peripherally to the rear wall 14. A permanent joining, as by stitching (not shown) between front wall 12 and rear wall 14, continuously extends generally from the top center 16 of the bag 10, along the right shoulder 18, as seen in FIG. 1, down the right side 20, across the bottom 22, and partially up from the bottom 22 along the left side 24. A zipper fastener 26 of extended length provides a reversible closure which extends upward from the termination 28 of the permanent joining, along the left side 24 and left shoulder 30 of the bag 10 and terminates substantially at the top center 16. The zipper slide element 32 is located adjacent the top center 16 when the zipper fastener 26 is in its closed condition. Accordingly when the zipper fastener 26 is fully opened, substantially an entire side 24 and one shoulder 30 are opened for the insertion or removal of garments on hangers in the known manner. The hangers are completely separable from the bag 10.

The garment bag 10 of this invention further includes a pair of tabs 34, symmetrically attached at the shoulders 18, 30 adjacent to the side joints 20, 24 and extending downward along the back wall 14. The male element 38 of a snap fastener is affixed to each tab 34, and mating female elements 40 of the snap fastener are alignedly attached to the front wall 12 near the bottom 22 of the garment bag 10. When the garment bag 10 is folded transversely (FIG. 4), the snap fastener elements 38 on the tabs 34, are releasably engaged with the fastener elements 40 on the front wall 12 to retain the bag 10 in the folded condition. The tabs 34 are fabricated from a flexible, durable material, e.g. leather, suited to carry the load imposed by the weight of the folded bag and its contents. Additional mating female elements 41 for the snap fastener are affixed to the back wall 14 in registration with the male elements 38 on the tabs 34 and are used to releasably grip the free ends of the tabs 34 when the bag 10 is not in a folded condition.

A central vertical strip 42 of material, e.g. cloth, leather, is attached, for example, by stitching, to the front wall 12 to provide reinforcement for, and to enhance the appearance of the bag 10.

Figure 3:
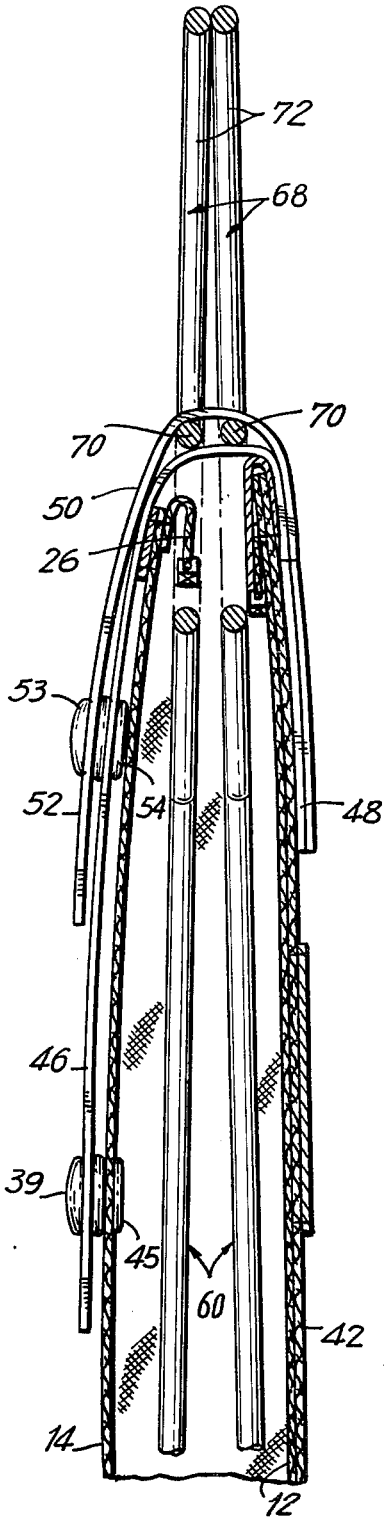
FIG. 3 is a view taken along the line 3—3 of FIG. 2.

A double strap assembly 44 is centrally attached to the front wall 12 proximate the top 16, for example, by stitching extended through the strap assembly 44, vertical strip 42 and front wall 12. The strap assembly 44 comprises a first flat, elongated, flexible, strap member 46 which is attached at one end 48 (FIG. 3) to the bag front wall 12, e.g. by stitching, as stated above. The other end 49 of the first strap member 46 is free for limited rotation about the fastened end 48 and includes a male snap fastener element 39 which when the bag is transversely folded releasably engages an aligned female snap fastener element 43 centrally attached to the front wall 14. Thus the folded-up portion of the bag 10 is supported by snap fasteners 38,40,39,43 at three locations, namely at the two lateral tabs 34 and at the central first strap member 46. When the bag 10 is extended to full length, the first strap member 46 is looped over the top of the bag 10 and connected to a female snap fastener element 45 located (FIG. 3) in registration on the back wall 14 of the bag.

The second strap member 50 of the double strap assembly 44 overlays the first strap member 46 and is affixed to both the first strap member 46 and the front wall 12 proximate the fixed end 48 of the first strap member 46. The other end 52 of the second strap member is free for limited rotation about the fastened end and includes a male snap fastener element 53 which releasably engages a female fastener element 54 on the outer surface of the first strap member 46. When both strap members 46, 50 are secured by the associated snap fasteners 39, 45, 53, 54, the strap members rest with substantial surface contact between them. However, the flexible quality of the overlayed strap members 46, 50 permits the hooks of hangers to be retained therebetween without permanent distortion of the straps 46, 50 as explained hereinafter.

Figure 2:
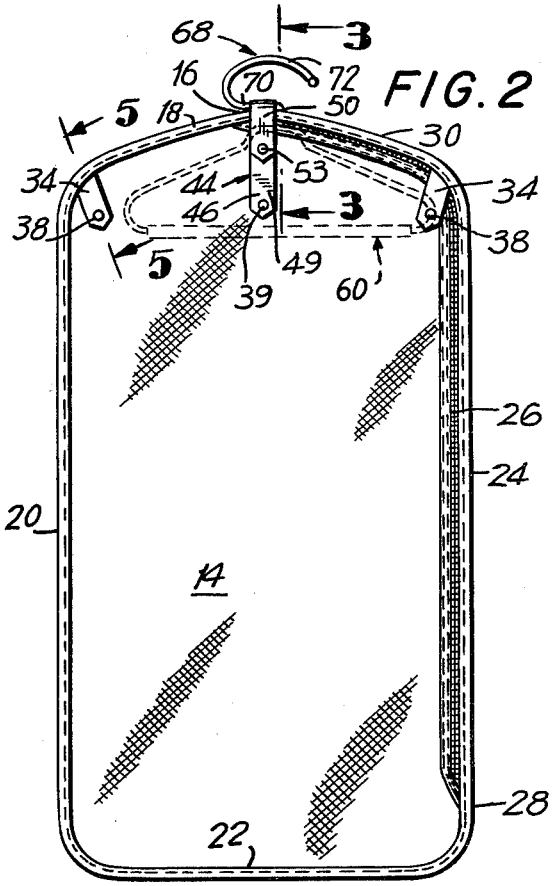
FIG. 2 is a rear view of the garment bag with hangers of FIG. 1.

The garment bag 10 is used in combination with separate clothing hangers 60 of generally conventional design, including downwardly sloping shoulder bars 62 connected at their center 63 and joined at the far ends 64 by a horizontal cross-bar 66. A hook 68, fabricated of stiff wire, is attached at the center 63 of the shoulder bar 62, and comprises a lower horizontal rod portion 70 (FIGS. 1, 2) extending away from the hanger center 63, and an integral rod portion 72 arching upward, and down, and passing over the center 63. Accordingly the hook 68 is substantially C-shaped and has a flat-bottomed profile as best seen in FIGS. 1 and 2.

In filling the garment bag 10 with hanging garments (not shown) the zipper fastener 26 is opened and the snap fastener elements on the double strap assembly 44 are opened. The clothing hanger 60 is removed from the interior of the bag 10 and the garments are suspended. Then the hanger 60 and associated garment are passed through the zippered opening with the C-shaped hanger hook 68 extending laterally above the bag shoulders 18, 30. The horizontal rod portion 70 of the hanger hook 68 passes over the center 16 of the bag 10. The first strap member 46 is looped under the horizontal rod 70 on the hanger hook 68 and attached to the rear wall 14 by means of the snap fastener 39, 45. Then the second strap member 50 is passed over the horizontal rod 70 on the hanger hook 68 and attached to the first strap member 46 by means of the snap fastener 53, 54. Thereby the hanger hook 68 is constrained vertically between the two strap members 46, 50 and laterally in one direction by the double strap assembly 44 and in the other lateral direction by the closed shoulder joint between front wall 12 and rear wall 14. The zipper fastener 26 is then closed by bringing the sliding element 32 up adjacent to the hook 68 at the top center 16 of the bag 10.

To place the loaded garment bag in a transversely-folded condition, the double strap assembly 44 is separated from the back wall 14 by opening the snap fastener 39, 45 engaging the first strap member 46. The hanger hook 68 remains secured between the two strap members 46, 50. The free ends of the tabs 34 are also separated from the back wall 14 by release from the female snap elements 41. The bag is then folded so that the snap fastener elements on the tabs 34 and first strap member 46 are in registration with the snap fastener elements 40,43 on the front wall 12. Pressure on the snap fasteners, in the known manner, releasably joins the folded-up bag portion to the upper bag portion. The loaded bag is carried, or suspended from a storage rack, by the C-shaped hooks 68. It should be noted that in using the double strap assembly 44, the stresses caused by the weight of folded garments are transmitted to the hanger hook 68 and thence via the strap members 46, 50 to the back wall 14 of the bag and to the reinforcing strip 42. Thus stresses on the zipper 26 and bag shoulders 18, 30 which might in some circumstances damage the bag 10 are relieved and directed to an area which is conveniently reinforced.

It should be obvious that the steps in using the garment bag 10 of this invention are not restricted to the order presented above. For example, the zipper may be closed before the strap members are fastened. The end result is unchanged by the sequence of steps used to constrain the hanger hook 68.

In alternative embodiments of this invention, the zippered opening is not limited to one bag side and a shoulder, but may extend substantially around the entire bag periphery. In another embodiment of this invention, the zippered opening may be located entirely in one wall, front or rear of the garment bag, and extending vertically, diagonally or in any direction and position suited to the insertion therethrough of hangers bearing garments It should further be understood that whereas zipper and snap fasteners have been described above in association with the garment bag 10 of this invention, other closures and fasteners, e.g. buttons, hooks, may be utilized in alternative embodiments.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In the combination of a foldable garment bag and separable hangers, the hooks of said hangers extending through an opening from the interior of said garment bag to provide a hand-grip for transporting said garment bag, the improvement therein comprising:

a first strap, one end of said first strap being fixedly attached to said bag, the other end of said first strap being positioned over a portion of each said hook and releasably attached to said bag, whereby said first strap constrains said hooks from motion away from said bag;

a second strap, one end of said second strap being fixedly attached to said bag, the other end of said second strap being positioned below each said portion of said hooks and having means for releasable attachment to said bag, whereby each said portion of said hooks is constrained between said first and second straps.

2. The combination of claim 1 wherein said first and second straps are overlayed, and said releasable attachment to said bag of said first strap is on said second strap.

3. The combination of claim 1 wherein said opening is at the top of said bag and includes closure means for reversibly extending said opening, whereby hangers with garments are placed in said bag when said opening is extended.

4. The combination of claim 1 wherein each said portion of said hooks is oriented substantially transversely to the length of said bag.

5. The combination of claim 1 wherein said bag includes an aperture of extended length for passage of hangers with garments therethrough, and said aperture includes reversible closure means whereby the length of said aperture is adjusted.

6. The combination of claim 5 wherein said reversible closure means is a zipper fastener.

7. The combination of claim 1 wherein said opening is at the top of said bag and further comprising means for releasably fastening the bottom of said bag to said second strap, whereby said bag is maintained in a folded-up condition.

8. The combination of claim 7 wherein said means for fastening said bottom cooperate with said means for releasably attaching said second strap to said bag.

9. The combination of claim 8 wherein said means for fastening comprise snap fasteners.

10. The combination of claim 7 and further comprising means for laterally engaging said bottom when said bag is in said folded-up condition.

11. The combination of claim 10 wherein said means for laterally engaging said bottom are lateral tabs at the top of said bag.

12. The combination of claim 11 wherein said lateral tabs releasably engage said bag adjacent said top when said bag is not folded.

13. The combination of claim 1 wherein said straps are fixedly fastened to one wall of said bag and releasably attached to the opposite wall of said bag.

14. The combination of claim 13 wherein each said hook is further constrained between said straps and the joint between said one wall and said opposite wall of said bag and between said one wall and said opposite wall.

15. The combination of claim 14, wherein said transverse portion of each said hook is integral with an arching portion whereby each said hook has a C-shape useful as a handgrip.

16. The combination of claim 15 wherein each said transverse portion is substantially linear.

* * * * *